US007462049B2

(12) United States Patent
Chen et al.

(10) Patent No.: US 7,462,049 B2
(45) Date of Patent: Dec. 9, 2008

(54) ELECTRICAL CONNECTOR

(75) Inventors: De-Jin Chen, ShenZhen (CN); Yu-San Hsiao, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/895,776

(22) Filed: Aug. 27, 2007

(65) Prior Publication Data

US 2008/0050955 A1 Feb. 28, 2008

(51) Int. Cl.
*H01R 13/629* (2006.01)

(52) U.S. Cl. ..... 439/160

(58) Field of Classification Search ..... 439/160, 439/157

See application file for complete search history.

(56) References Cited

U.S. PATENT DOCUMENTS 5,364,282 A * 11/1994 Tondreault ..... 439/157
5,389,000 A * 2/1995 DiViesti et al. ..... 439/157
6,368,126 B1 * 4/2002 Lee ..... 439/160
6,390,837 B1 * 5/2002 Lee ..... 439/160
6,616,466 B2 * 9/2003 Frantum et al. ..... 439/157
2002/0076959 A1 * 6/2002 Lee ..... 439/160
2005/0196992 A1 * 9/2005 Tanigawa ..... 439/160

* cited by examiner

*Primary Examiner*—Gary F. Paumen
(74) *Attorney, Agent, or Firm*—Wei Te Chung

(57) ABSTRACT

An electrical connector, for connecting an electrical connector to a circuit board, comprises an insulative housing defining a plurality of passages in an end thereof, a plurality of contacts received in the insulative housing, and an ejecting member being pivotally attached within the end of the housing and the ejecting member having a plurality of cam-type spindles received in the passages. The cam-type spindle defines a first cam surface and a second cam surface in a rotation direction of the cam-type spindle, respectively, the passage defines a first retaining surface and a second retaining surface corresponding to the first cam surface and the second cam surface, respectively, for preventing the ejecting member from further rotation.

14 Claims, 5 Drawing Sheets

ELECTRICAL CONNECTOR

BACKGROUND OF THE INVENTION

1. Field of the Invention

The present invention relates to an electrical connector, and more particularly, to an electrical connector provided with ejecting member can be avoided over-rotation.

2. Background of the Invention

U.S. Pat. No. 5,364,282 issued to Robert on Nov. 15, 1994 discloses an electrical connector socket with daughtercard ejector. It generally discloses an insulative housing 12 for receiving a daughtercard. Both ends of the housing 12 are formed to include an opening 20 having an identical configuration for receiving an ejector 22 therein. An ejector 22 is pivotably couoled to each end of socket within opening 20. The ejector 22 is used for not only locking the electronics component in the housing 12, but also ejecting the electronics component from the housing 12 in the unlatching status.

At least two problems may occur in the electrical connector socket of the Robert '282 patent wherein the first one is that there is no means for limiting the rotation of axles 28 such that the rotation of the ejector 22 can not be limited with regard to the housing 12, that may result that the ejector 22 hits or jeopardizes the components which are mounted on the circuit board closely adjacent to the end of the housing 12 which the ejector 22 is mounted. The second problem is that the opening 20 is substantially somewhat too large to jeopardize the strength of the corresponding portions of the housing 12.

In view of the above, a new electrical connector socket, which enables to overcome the above-mentioned disadvantages is desired.

SUMMARY

Therefore, a need exists for an electrical connector, which enables to prohibit the ejecting member from over-rotation during ejecting the electronic component from the housing.

According to a preferred embodiment of the invention, an electrical contact, for electrically connecting an electronic component with a circuit member, comprises an elongated insulative housing with a central slot for receiving an electronic component therein wherein two rows of contacts are positioned on two sides of the slot. A pair of cavities is provided at two opposite ends of the housing for receiving a pair of corresponding ejecting members therein. A pair of cam-type spindles is defined in the sides of the ejecting member and a pair of passages is provided at two opposite ends of the housing for receiving the corresponding cam-type spindles. The cam-type spindle each defines a first cam surface and a second cam surface in the direction of rotational movement of the cam-type spindle, correspondingly, the passage defines a first retaining surface against the first cam surface in the unlatching status and a second retaining surface against the second cam surface in the latching status so as to control the rotation scope of the ejecting member.

The present invention has several advantages as below: the passage defines a first retaining surface and a second retaining surface for retaining the corresponding the first cam surface and the second cam surface, respectively, thus, the rotation scope of the ejecting member is controlled.

The present invention will be well understood when read in junction with the following drawing, in which:

DETAILED DESCRIPTION OF THE PREFERRED EMBODIMENT OF THE INVENTION

The invention will now be described in greater detail with reference to the figures.

Figure 1:
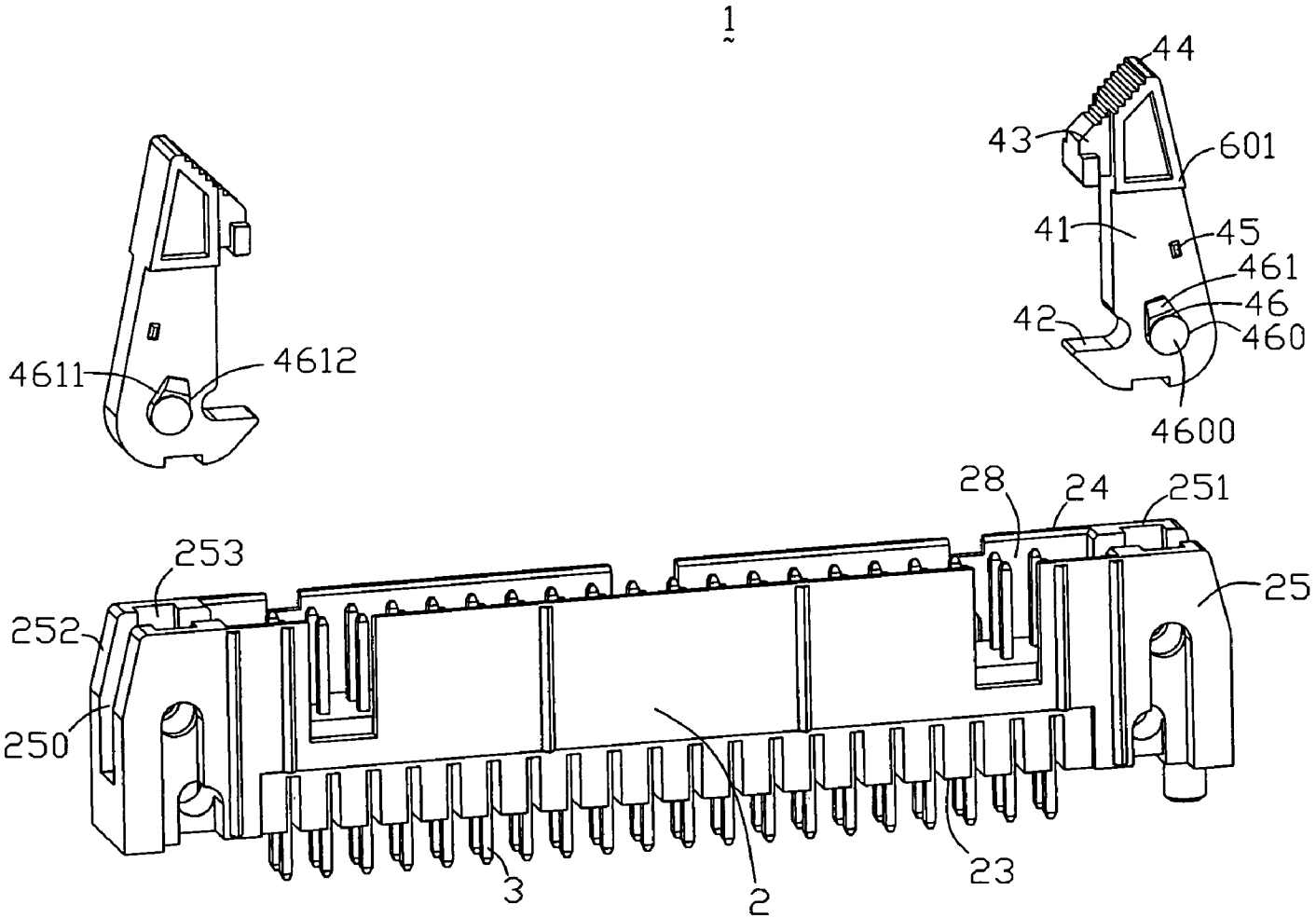
FIG. 1 is an exploded, isometric view of an electrical connector in accordance with a preferred embodiment of the present invention.
Figure 2:
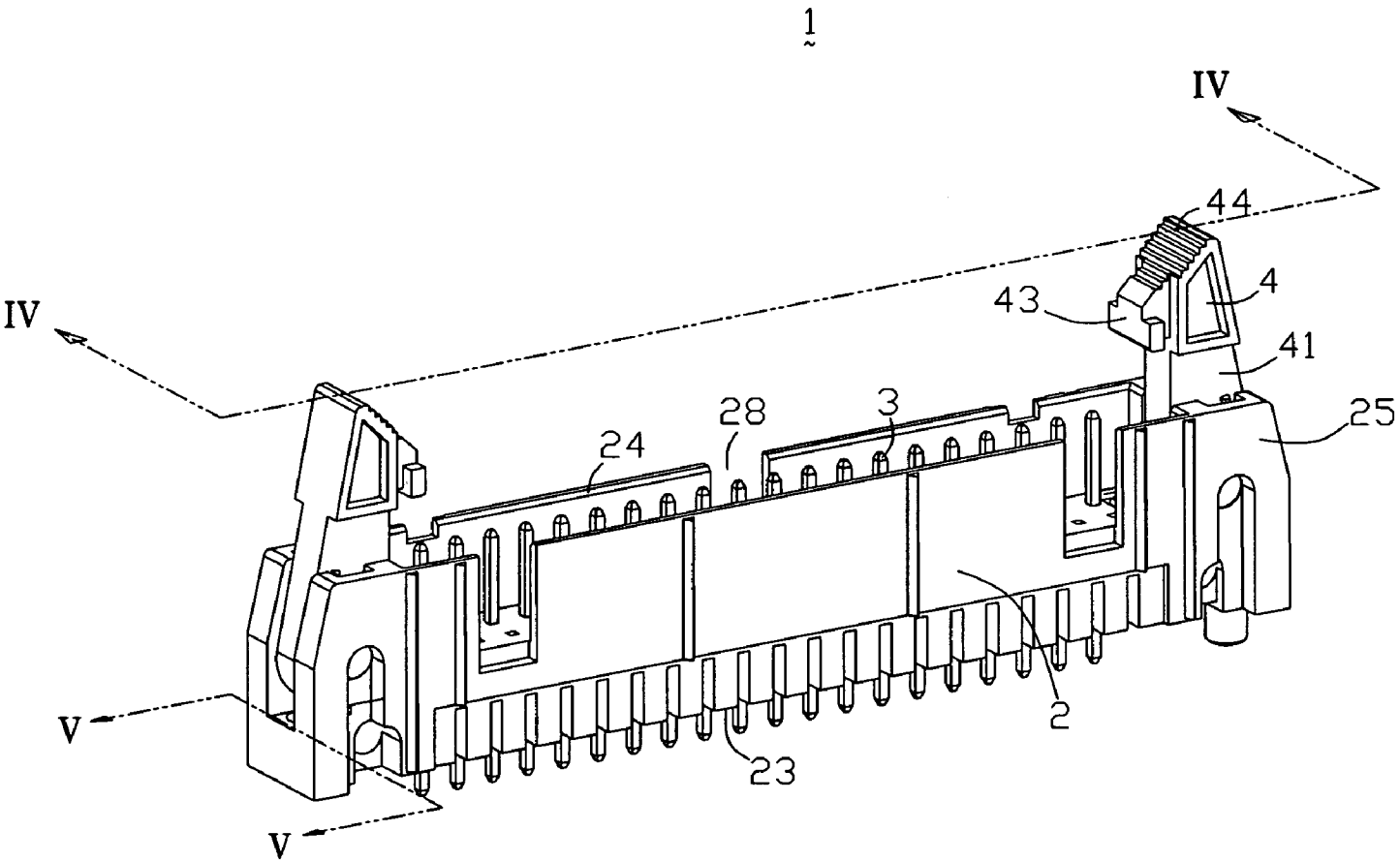
FIG. 2 is an assembled view of the electrical connector of FIG. 1.
Figure 3:
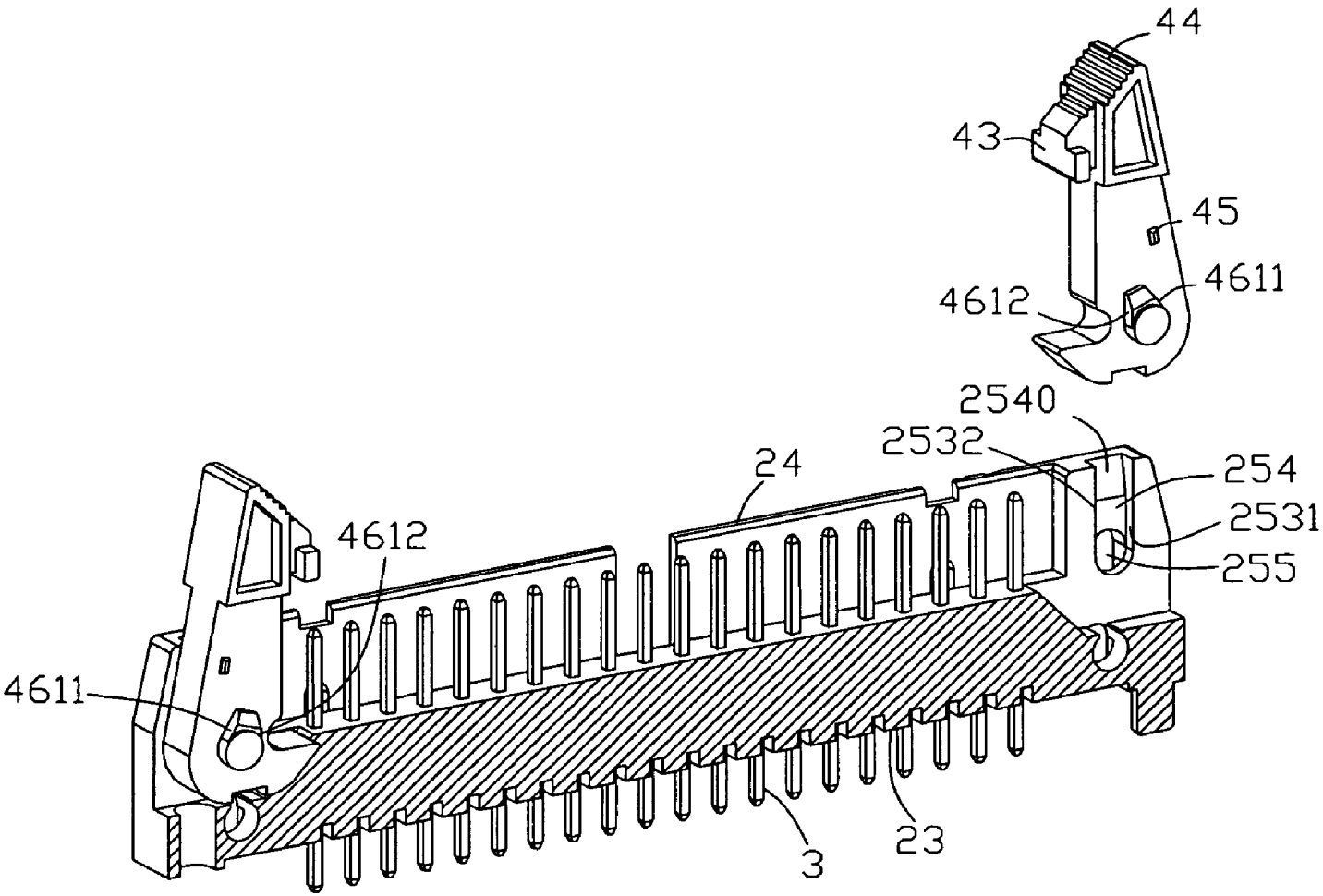
FIG. 3 is a partial cross-section view taken along the center line of the housing of FIG. 1, one ejecting member being assembled in the housing.

Referring to FIGS. 1-3, an electrical connector 1 for attaching an electronic component (not shown) to a circuit board (not shown) includes an elongated insulative housing 2 having a central slot 28 extending along its lengthwise direction, two rows of contacts 3 positioned on two sides of the slot 28 and a pair of ejecting member 4 receiving in the housing 2 and defining a pair of cam-type spindles 41 in the sides thereof.

The elongated housing 2 defines an upper connection face 24 and an opposed lower mounting face 23. Connecting face 24 may accommodate a mating electrical connector (not shown) for mating engagement with the electrical connector 1. Mounting face 23 may be mounted onto a circuit board so that the electrical connector 1 establishes electrical connection between the mating connector and the circuit board. The contact 3 extends through the connection face 24 and the lower mounting face 23. The insulative housing 2 defines two relative ends 25 in the lengthwise direction. The ends 25 defines two relative side walls 251 and two end walls 252 connecting with the side walls 251, the side walls 251 and the end walls 252 forms a receiving portion 250 for receiving the ejecting member 4. The side walls 251 defines a passage 253 for receiving the cam-type spindle 46 and the passage 253 extends from the upper connection face 24 to the lower mounting face 23. The passage 253 comprises a leading groove 254 and a through hole 255 impenetrating the side wall 255. The leading groove 254 is communicated with the through hole 255. The leading groove 254 defines a leading surface 2540 which is prone to insert for the cam-type spindle 46. The passage 253 defines a first retaining surface 2531 and a second retaining surface 2532 in the opposite sides thereof.

The contact 3 is configured into a pin-shaped. The upper end of the contact 3 mates with the mating electronic device and the lower of the contact 3 connects with the circuit board so as to form a connection between the mating electronic device and the circuit board.

Figure 4:
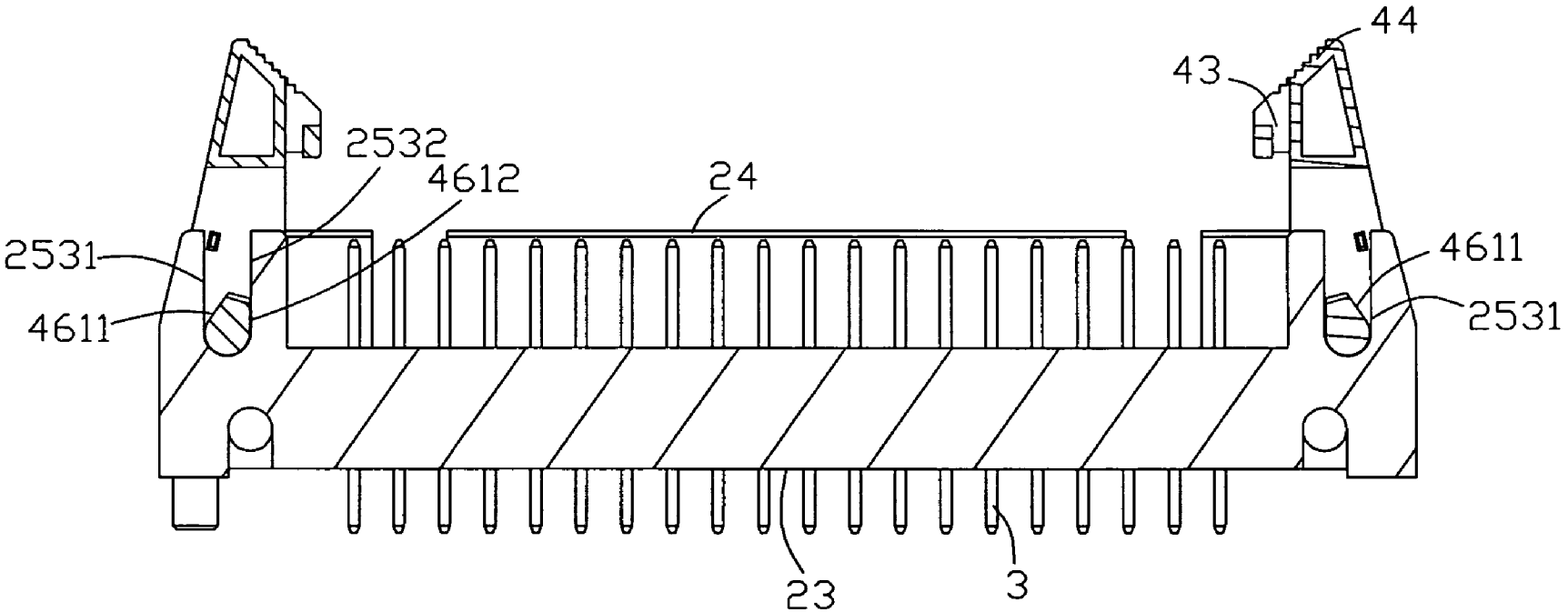
FIG. 4 is a cross-section view taken along line IV-IV of FIG. 2.
Figure 5:
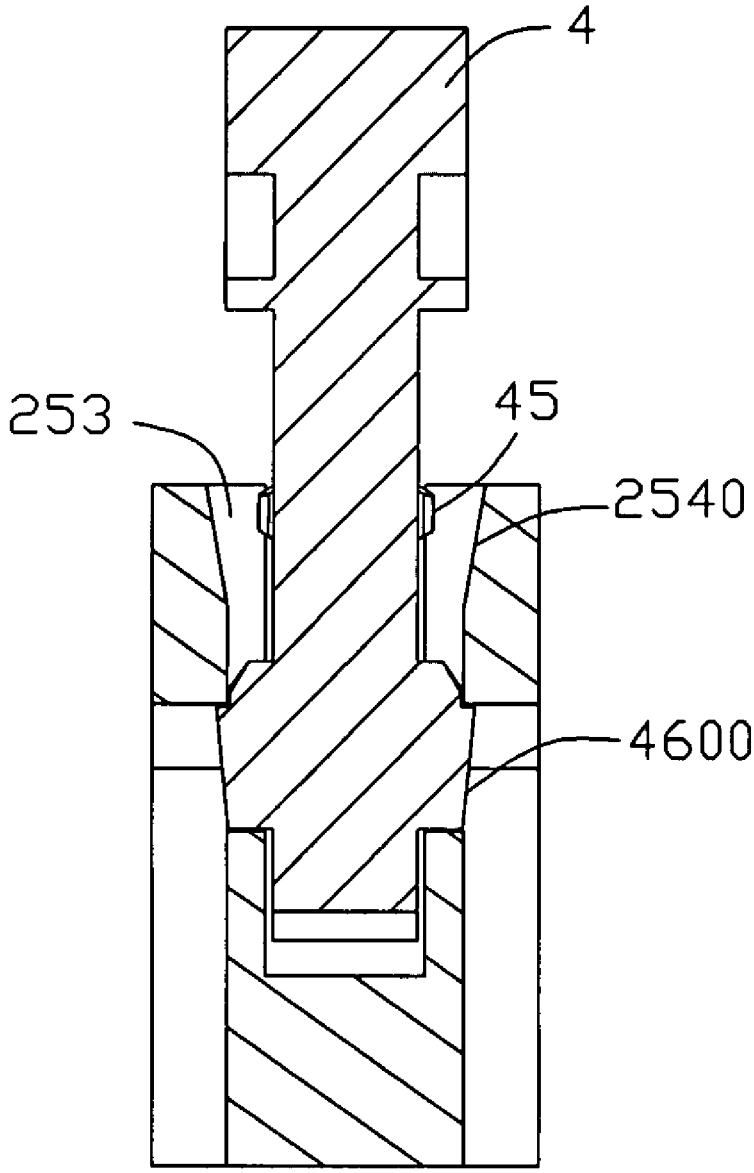
FIG. 5 is a cross-section view taken along line V-V of FIG. 2.

Referring to FIG. 4 and FIG. 5, the ejecting member generally includes a main body 41 having an eject portion 42 horizontally extending at the bottom end and a locking portion 43 horizontally extending at the top end with a lever portion 44 obliquely upward extending opposite to the locking portion 43. Two sides of the main body 41 define a pair of dimples 45 and a pair of cam-type spindles 46 below wherein such pair of cam-type spindles 46 are adapted to be received within the corresponding passage 253. The cam-type spindle 46 includes a whirling portion 460 with a cylinder-shaped and a retaining portion 461 connecting with the whirling portion 460. The whirling portion 460 receives in the through hole 255 and defines an inclined surface 4600 for easy insertion of the cam-type spindles 46 into the corresponding passage 253. The retaining portion 461 extends upward from the whirling portion 460 and defines a first cam surface 4611 and a second cam surface 4612 in the direction of rotational movement of the cam-type spindle 46. The first retaining surface 2531 retains the first cam surface 4611 in the latching status and the second retaining surface 2532 retains the second cam surface in the unlatching status so that the rotation scope of the ejecting member 4 is controlled.

In assembly, the pair of ejecting member 4 are moved to the ends 25 of the housing 2 wherein the inclined surface 4600 connects the leading surface 2540 and the cam-type spindle 46 may pass through the leading surface 2540 and into the through hole 255. Then secondly, the ejecting member 4 is vertically pressed down in a press-fit with the cam-type spindles 46 thereof moving along the leading surface 2540 until such cam-type spindles 46 are properly received within the corresponding passages 253. The position where the first retaining surface 2531 retains the first cam surface 4611 is the first position and the position where the second retaining surface 2532 retains the second cam surface 4612 is the second position, thus, the ejecting member 4 may rotate between the first position and the second position so that it enables to prohibit the ejecting from over-rotation.

While preferred embodiment in accordance with the present invention has been shown and described, equivalent modifications and changes known to persons skilled in the art according to the spirit of the present invention are considered within the scope of the present invention as defined in the appended claims.

What is claimed is:

1. An electrical connector, for connecting an electronic part to a circuit board, comprising:

an insulative housing defining a plurality of passages in an end thereof;

a plurality of contacts received in the insulative housing;

an ejecting member being pivotally attached within the end of the housing and the ejecting member having a plurality of cam-type spindles received in the passages;

wherein the cam-type spindle defines a first cam surface and a second cam surface in a rotation direction of the cam-type spindle, respectively, the passage defines a first retaining surface and a second retaining surface corresponding to the first cam surface and the second cam surface, respectively, for preventing the ejecting member from further rotation.

2. The electrical connector as claimed in claim 1, wherein the insulative housing further includes a central slot for receiving the electronic part.

3. The electrical connector as claimed in claim 1, wherein the ejecting member generally includes a main body having an eject portion extending at the bottom end and a locking portion extending at the top end with a lever portion obliquely upward extending opposite to the locking portion.

4. The electrical connector as claimed in claim 3, wherein two sides of the main body of the ejecting member define a pair of dimples that received in the passages of the insulative housing.

5. The electrical connector as claimed in claim 1, wherein the end of the housing defines two relative side walls and two end walls connecting with the side walls, the side walls and the end walls form a receiving portion for receiving the ejecting member.

6. The electrical connector as claimed in claim 5, wherein the passage forms in the side wall.

7. The electrical connector as claimed in claim 6, wherein the passage defines a leading surface that is prone to insert for the cam-type spindle.

8. The electrical connector as claimed in claim 7, wherein the cam-type spindle defines a inclined surface extending upward from bottom for easy insertion of the cam-type spindles into the corresponding passage.

9. An electrical connector, for connecting an electronic part to a circuit board, comprising:

an insulative housing defining a central slot between two longitudinal side walls with at least one passage on an inner face of one of said side walls at an end thereof, said passage extending in a direction parallel to an insertion direction of said electronic part;

a round hole communicating with said passage in a transverse direction perpendicular to said direction;

a plurality of contacts received in the insulative housing; and an ejecting member being pivotally attached within the end of the housing and the ejecting member having on one surface at least one spindle defining an outer round section snugly received in the round hole and an inner non-round section moveably received in the passage; wherein rotation of said ejecting member is limited by engagement between the passage and the inner non-round section.

10. The electrical connector as claimed in claim 9, wherein said outer round section is dimensioned with a diameter not larger than a width of said passage.

11. The electrical connector as claimed in claim 9, wherein the outer round section has a same diameter with a bottom portion of said inner non-round section.

12. The electrical connector as claimed in claim 9, wherein said inner non-round section defines a long extension which is larger than a diameter of said outer round section.

13. The electrical connector as claimed in claim 9, wherein said surface further defines a stopper protrusion spaced from the spindle while being engaged with the passage when said ejecting member is located in one of an open position and a closed positions so as to cooperate with the outer non-round section of the spindle to retain the ejecting member is said one position.

14. The electrical connector as claimed in claim 13, wherein said one position is the open position.

* * * * *